US011377871B2

(12) United States Patent
Escure et al.

(10) Patent No.: US 11,377,871 B2
(45) Date of Patent: Jul. 5, 2022

(54) ANCHORING SYSTEM FOR A FENCE

(71) Applicant: TransGard LLC, York, PA (US)

(72) Inventors: Ryan Escure, York, PA (US); William Reichard, York, PA (US)

(73) Assignee: TransGard LLC, York, PA (US)

( * ) Notice: Subject to any disclaimer, the term of this patent is extended or adjusted under 35 U.S.C. 154(b) by 426 days.

(21) Appl. No.: 16/688,474

(22) Filed: Nov. 19, 2019

(65) Prior Publication Data

US 2020/0240171 A1 Jul. 30, 2020

Related U.S. Application Data

(60) Provisional application No. 62/798,803, filed on Jan. 30, 2019.

(51) Int. Cl.
*E04H 17/20* (2006.01)
*E04H 17/22* (2006.01)

(52) U.S. Cl.
CPC ..... *E04H 17/22* (2013.01)

(58) Field of Classification Search
CPC ..... E04H 17/16; E04H 17/17; E04H 17/20; E04H 17/22; E04H 17/24
See application file for complete search history.

(56) References Cited

U.S. PATENT DOCUMENTS 1,131,681 A * 3/1915 Demares ..... E04H 17/22 52/150
1,859,509 A * 5/1932 Haverstick ..... E04H 17/24 256/1
3,881,698 A * 5/1975 Marsh ..... E04G 21/3233 248/231.41
4,124,198 A * 11/1978 Wong ..... E04H 17/16 256/73
4,462,573 A * 7/1984 Melfi ..... E04G 21/3223 256/65.14
4,830,341 A * 5/1989 Arteau ..... E04G 21/3276 52/37
5,240,230 A * 8/1993 Dougherty ..... E04H 17/003 52/156
5,791,635 A * 8/1998 Hull ..... E04H 12/223 52/156
5,899,171 A * 5/1999 Abrahamson ..... E04H 17/22 119/512
6,467,756 B1 * 10/2002 Elsasser ..... E04H 17/1413 52/832
7,188,457 B1 * 3/2007 Halama ..... E04H 12/2253 248/501
7,503,550 B2 * 3/2009 Liefke ..... E04H 12/2223 256/65.14
7,802,351 B2 * 9/2010 McGinness ..... E04H 12/2253 29/458

(Continued)

*Primary Examiner* — Daniel J Wiley
(74) *Attorney, Agent, or Firm* — Troutman Pepper Hamilton Sanders LLP

(57) ABSTRACT

An anchoring system for a fence attaches to a portion of the fence and secures the fence to a subsurface to anchor the fence and thereby inhibit unwanted movement of the fence due to winds or other outside forces. The anchoring system has a stand that forms a base and a rigid pole extending upwardly from the stand. A top connector removably attaches the rigid pole to a portion of the fence and at least one in-ground anchor secures the stand to a subsurface.

17 Claims, 8 Drawing Sheets

(56) References Cited

U.S. PATENT DOCUMENTS

| | | | | |
|---|---|---|---|---|
| 8,925,904 | B2 * | 1/2015 | Christoffer | E04H 17/22 182/113 |
| 9,447,599 | B1 * | 9/2016 | Parent | A47G 29/1216 |
| 2002/0043036 | A1 * | 4/2002 | Nesbitt | E04H 17/20 52/301 |
| 2005/0173690 | A1 * | 8/2005 | Penning | E01F 9/627 256/65.14 |
| 2008/0164451 | A1 * | 7/2008 | Liefke | E04H 12/2223 256/59 |
| 2008/0277543 | A1 * | 11/2008 | Daysh | E04H 17/22 248/205.1 |
| 2011/0017968 | A1 * | 1/2011 | Christoffer | E04G 21/3223 256/65.14 |
| 2012/0192507 | A1 * | 8/2012 | Paananen | E04H 12/2284 52/155 |
| 2012/0261630 | A1 * | 10/2012 | Sadinsky | E04H 17/22 403/187 |
| 2014/0259901 | A1 * | 9/2014 | Williams | E04H 17/20 29/458 |
| 2015/0069313 | A1 * | 3/2015 | Christoffer | E04H 17/22 256/65.14 |
| 2015/0240515 | A1 * | 8/2015 | Davis | E04H 17/20 256/1 |
| 2015/0259943 | A1 * | 9/2015 | Paananen | E04H 12/2269 52/159 |
| 2016/0076270 | A1 * | 3/2016 | Yandell | E04H 12/2238 52/153 |
| 2017/0058557 | A1 * | 3/2017 | Wu | E04H 17/22 |
| 2017/0370120 | A1 * | 12/2017 | Billings | E01F 13/028 |
| 2018/0245301 | A1 * | 8/2018 | Herdman | E04H 12/00 |
| 2019/0119870 | A1 * | 4/2019 | Davey | E04H 12/2292 |
| 2019/0368221 | A1 * | 12/2019 | Stager | E04H 17/12 |

* cited by examiner

ANCHORING SYSTEM FOR A FENCE

CROSS-REFERENCE TO RELATED APPLICATIONS

This application claims the benefit of priority of U.S. Provisional Patent Application No. 62/798,803, filed on Jan. 30, 2019, the entire contents of which are hereby incorporated by reference herein.

TECHNICAL FIELD

This disclosure relates to an anchoring system for a fence. More particularly, this disclosure relates to a stand-up pipe system that connects to a fence post and is securable to a subsurface such as the ground.

BACKGROUND

Fencing and other wall structures are usually intended to be stationary to form a barrier between two areas. For example, permanent fencing often includes support posts that are directly embedded in the ground. However, some fencing is made to be more modular or temporary and therefore may include large sections that are relatively movable, especially under high wind conditions. In these situations, unwanted movement and/or misalignment of fencing modules may occur, leading to possible damage, unwanted entry past the barrier, or impingement of property.

Electric fencing presents another challenge to the problem of anchoring fencing in place, due to the restriction on materials that may come into contact with an electric grid that may be present on the fencing. In particular, if a metal anchor were to contact the electric grid, the circuit may be grounded and/or unwanted components of the fence may become electrified. This may lead to malfunctioning of the electric fence and/or the potential for unexpected danger to people.

The present disclosure addresses these and other problems of the prior art related to anchoring systems for a fence.

SUMMARY

Some embodiments provide an anchoring system for a fence. The anchoring system includes a stand configured to form a base, a rigid pole extending upwardly from the stand a top connector configured to removably attach the rigid pole to a portion of a fence, and at least one in-ground anchor configured to secure the stand to a subsurface.

Some other embodiments provide a fence. The fence includes a fence panel and an anchoring system. The fence panel includes a plurality of vertical posts, including an end post. The anchoring system includes a stand configured to form a base, a rigid pole extending upwardly from the stand, a top connector configured to removably attach the rigid pole to the end post, and at least one in-ground anchor configured to secure the stand to a sub surface.

Some other embodiments provide a fence including a plurality of fence panels and a plurality of anchoring systems. Each fence panel includes a first end post and a second end post. Each anchoring system includes a stand configured to form a base, a rigid pole extending upwardly from the stand, a threaded cap configured to removably attach the rigid pole to the first end post of a fence panel of the plurality of fence panels, and at least one in-ground anchor configured to secure the stand to the subsurface. Each anchoring system is configured to secure a respective one of the plurality of fence panels to a subsurface and connect to an adjacent one of the plurality of fence panels to form an interconnected fence along a fence line.

These and other variants will be appreciated by those of skill in the art upon reading the description below.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

The present disclosure describes an anchoring system for a fence. The anchoring system includes features that enable connection to a fence and securement to a subsurface such as the ground. In at least one embodiment, the anchoring system includes an upright rigid pole that is securable at one location to the fence and at another location to the ground through one or more in-ground anchors. In one embodiment, the top connector is a cap that secures to a top end of an end post of the fence and the rigid pole of the anchoring system.

Figure 1:
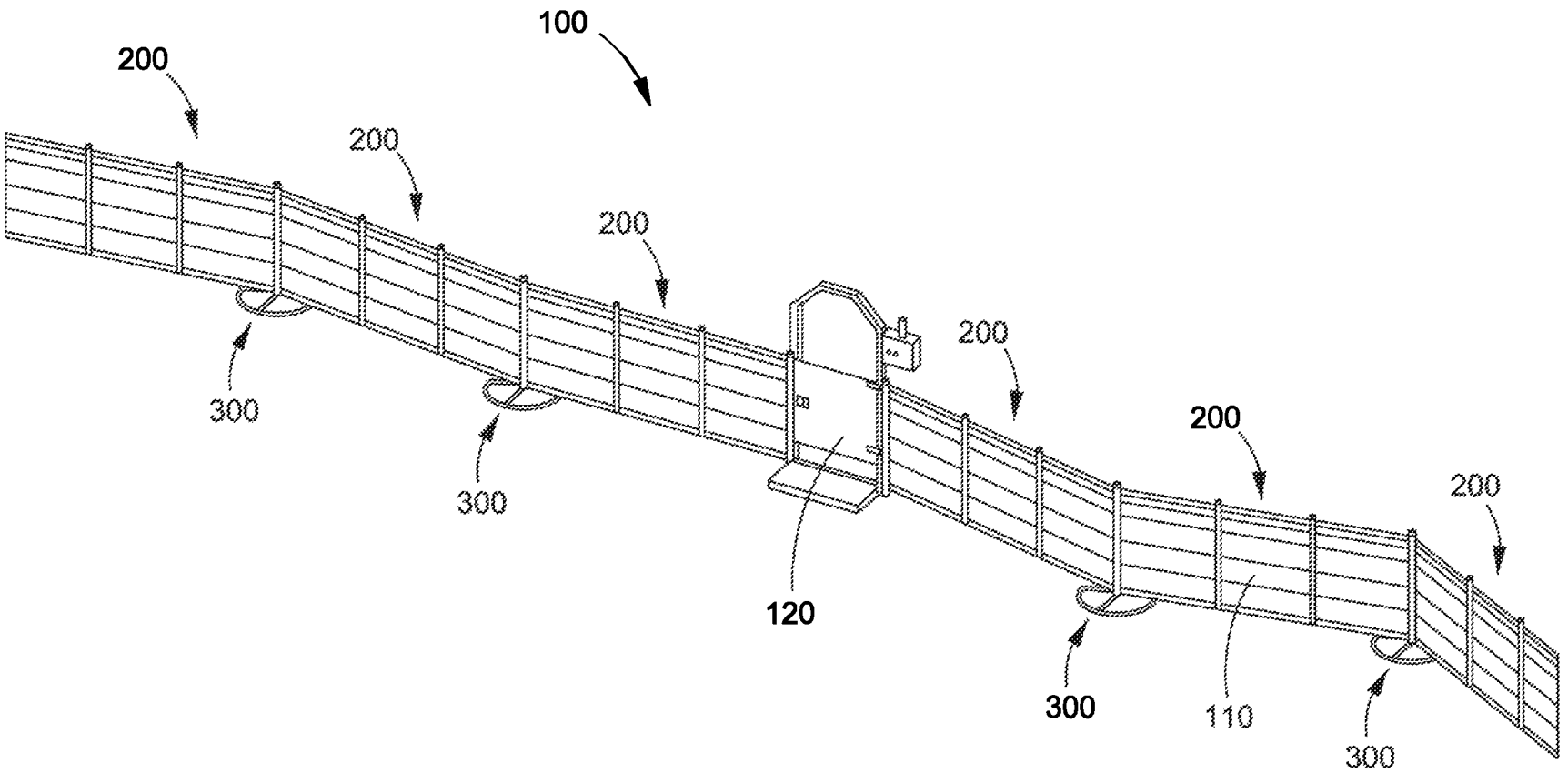
FIG. 1 is a perspective illustration of a modular fence.

FIG. 1 depicts an exemplary fence 100, consistent with disclosed embodiments. The fence 100 may be a modular fence including a plurality of interconnected fence panels 200 that stand upright and extend along and establish a fence line. The fence 100 may be any type of fence, made from any type of material suitable for the intended use. In an exemplary embodiment, the fence 100 is an electric fence, such as the modular electric fence described in U.S. Pat. No. 6,712, 339, entitled "Modular Fence" and issued on Mar. 30, 2004, which is hereby incorporated by reference in its entirety. The fence 100 may include an electrified grid 110 that is exposed on an exterior surface of the fence 100. In some embodiments, a door 120 is positioned between a pair of the panels 200.

The fence 100 may include a plurality of anchoring systems 300 that are arranged at various points along the fence line. The anchoring systems 300 are configured to secure the fence 100 to a subsurface, such as the ground. The term "subsurface" and "ground" are used interchangeably herein, and both encompass a substrate on which the fence 100 may sit and be secured. These terms encompass materials such as gravel, dirt, rocks, and the like. The anchoring systems 300 are configured to enhance the stability of the fence 100 and inhibit movement of the fence 100, even under high wind conditions. In an exemplary embodiment, the anchoring systems 300 are located at the interconnection.

Figure 2:
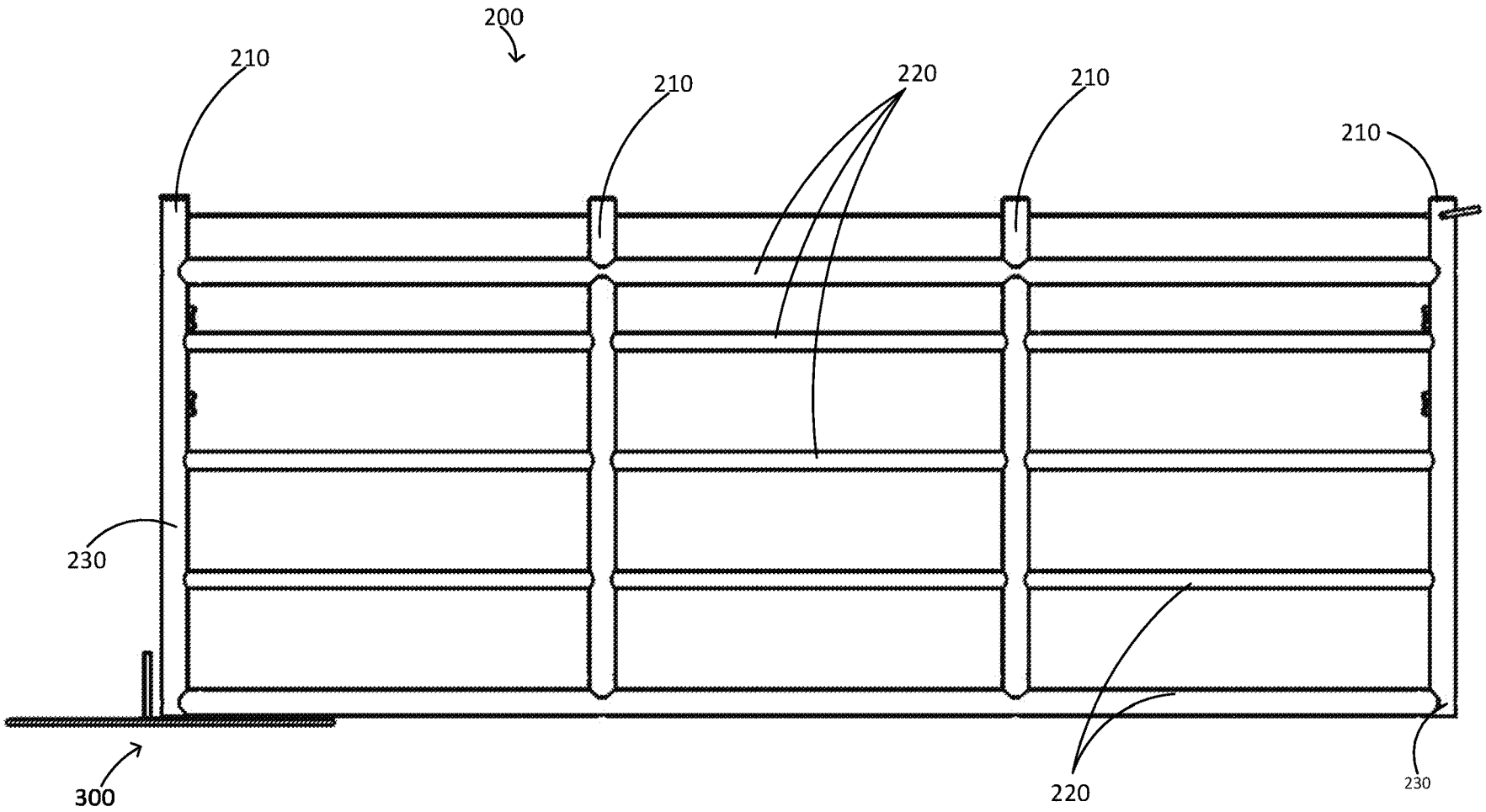
FIG. 2 is a front view of a panel of the modular fence of FIG. 1.

FIG. 2 is a front view of an exemplary panel 200 of the fence 100. The panel 200 may be formed of a plurality of vertical posts 210 and horizontal posts 220. The posts 210 and 220 may support the electrified grid 110 to form an electric fence barrier. The vertical posts 210 may include end posts 230 that form longitudinal ends of the panel 200. In an exemplary embodiment, the posts 210, 220 may be formed from a non-conductive material, such as PVC piping or other plastic. The anchoring system 300 is configured, in some embodiments, to attach to an end post 230 of the panel 200.

Figure 3:
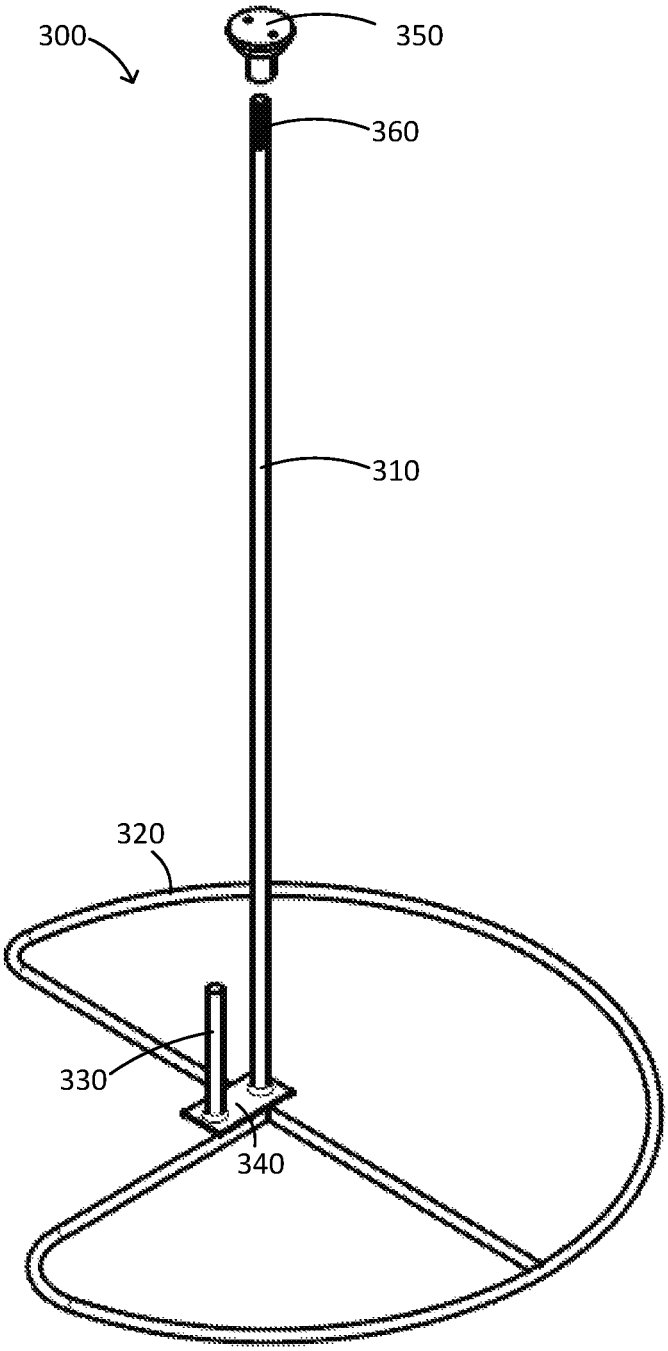
FIG. 3 is a perspective view of an anchoring system, according to an embodiment.

FIG. 3 is a perspective view of an embodiment of the anchoring system 300. In an exemplary embodiment, the anchoring system 300 includes a rigid pole 310, a stand 320, an adjacent post 330, a connection bracket 340, and a top connector 350. The rigid pole 310 may extend generally vertically from the stand 320. The stand 320 may be formed to create a support area that sits on the ground and forms a base for the anchoring system 300. In one embodiment, the stand 320 has a wire frame configuration that is shaped to both connect to the bracket 340 and create a perimeter to form a sturdy base. For example, the stand 320 may have a generally circular configuration with a cross bar, as shown in FIG. 3. However, it should be understood that embodiments of the stand 320 are not limited to this configuration.

The bracket 340 connects the stand 320 to the rigid pole 310. The bracket 340 also connects the stand 320 and rigid pole 310 to the adjacent post 330. The rigid pole 310 is configured to connect to an end post 230 of a first panel 200. The adjacent post 330 is configured to connect to an end post 230 of a second panel 200 that sits adjacent to the first panel 200 on the fence line. The adjacent post 330 is preferably shorter than the rigid pole 310. The shorter adjacent post 330 allows the second panel 200 to be easily removed from the anchoring system 300, such as by lifting the second panel 200 off of the adjacent post 330.

The top connector 350 is an element configured to connect the rigid pole 310 to an end post 230 of a fence panel 200. In one embodiment, the top connector 350 is a cap. An upper end 360 of the rigid pole 310 is threaded and configured to mate with a threaded end of the cap in order to secure the cap to the rigid pole 310. While a cap is described and illustrated, it should be understood that the top connector 350 may take other forms. For example, the top connector 350 may be a bracket, screw, clip, pin, etc. The top connector 350 is preferably removable in order to maintain a modular approach to the fence 100, but may be permanently affixed in some embodiments.

Figure 4C:
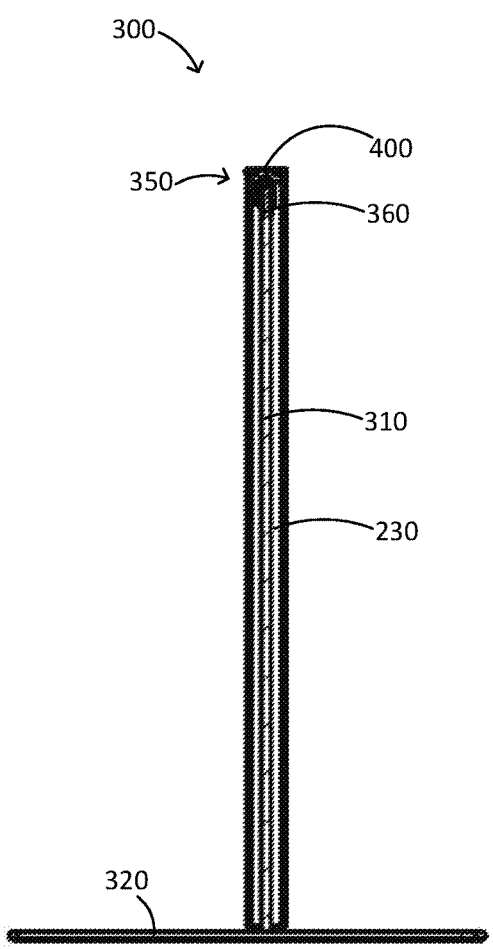
FIG. 4C is a cross-sectional view of the anchoring system and end post, taken along line A-A of FIG. 4B.
Figure 4B:
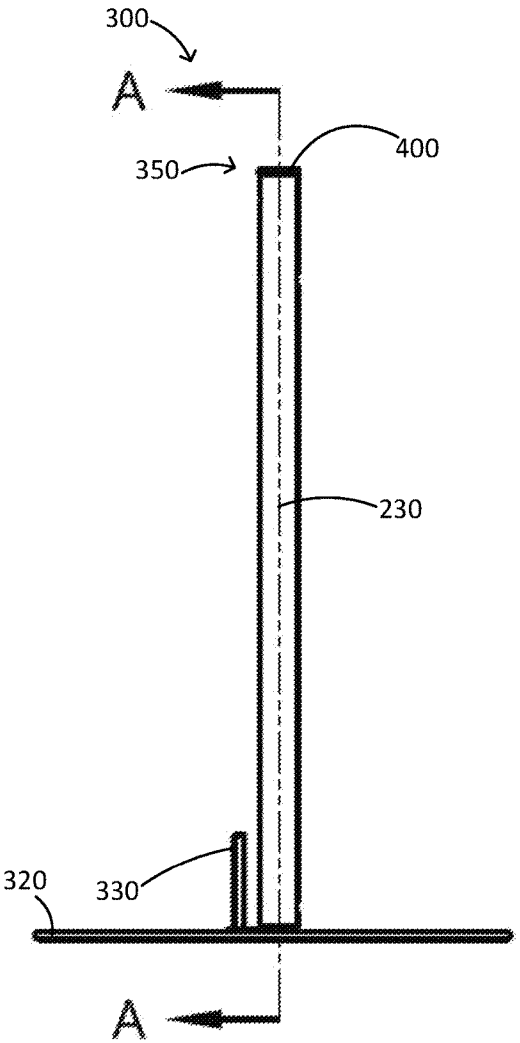
FIG. 4B is a front view of the anchoring system and end post of FIG. 4A.
Figure 4A:
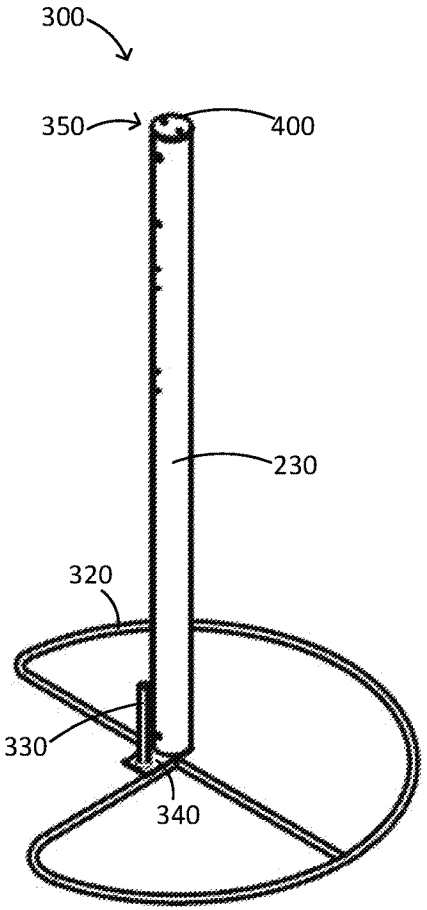
FIG. 4A is a perspective view of the anchoring system of FIG. 3 installed on an end post.

FIGS. 4A-4C further illustrate the anchoring system 300 connected to an end post 230 of a fence panel 200. In an exemplary embodiment, the rigid pole 310 extends through the hollow center of the end post 230. The stand 320 and bracket 340 prevent the rigid pole 310 from being pulled out of a top of the end post 230. The top connector 350 connects to an upper portion of the end post 230 to thereby secure the end post 230 to the rigid pole 310. In an exemplary embodiment, the top connector 350 is a threaded cap 400 that includes a diameter that is larger than an inner diameter of the end post 230, such that at least a portion of the cap 400 cannot fit through the end post 230.

Figure 5B:
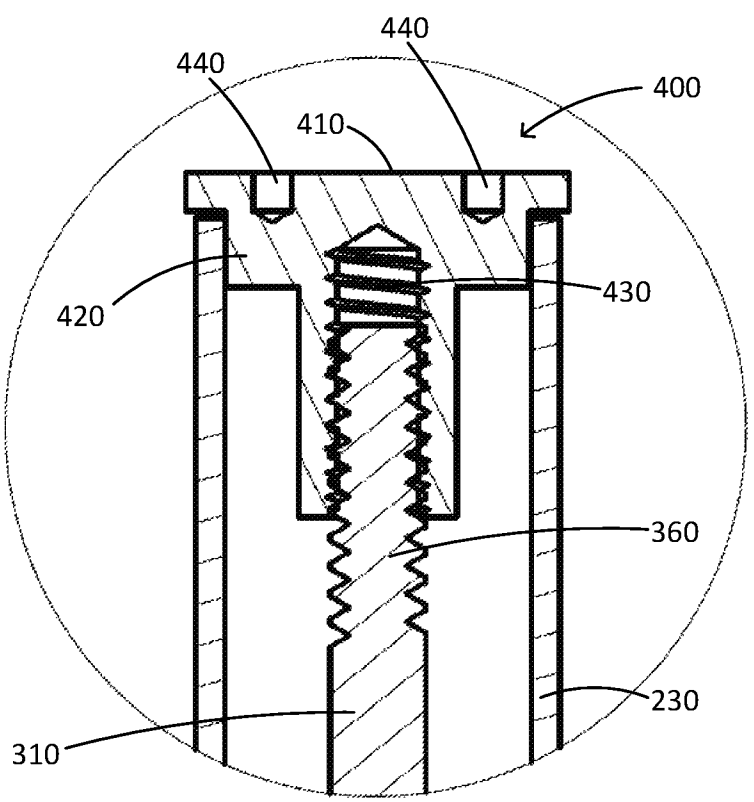
FIG. 5B is a close-up view of the top connector of FIG. 5A, in a connected position.
Figure 5A:
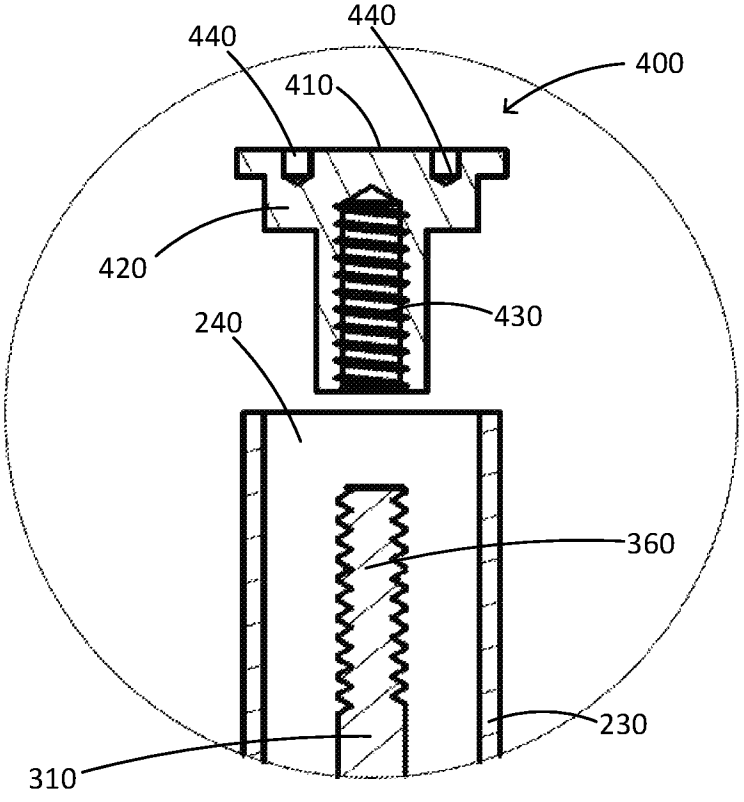
FIG. 5A is a close-up view of a top connector of the anchoring system, in a disconnected position.

FIGS. 5A-5B illustrate an embodiment of a top connector 350 in the form of the cap 400. In an exemplary embodiment, the cap 400 includes an upper surface 410, a plug 420, a threaded element 430, and removal holes 440. The upper end 360 of the rigid pole 310 is threaded. While the threaded element 430 of the cap 400 is shown as a female connector and the threaded portion of the upper end 360 of the rigid pole 310 is shown as a male connector, it should be understood that this configuration may be reversed. Further, other types of removable connections may be used.

The threaded element 430 and plug 420 fit into an opening 240 in a top of the end post 230. However, the upper surface 410 is larger than the opening 240 such that a flange of the cap 400 sits on an upper edge of the end post 230. The threaded element 430 and threaded portion of the upper end 360 of the rigid pole 310 are mated to each other, thereby preventing the rigid pole 310 from being removed from a bottom of the end post 230. Together with the stand 320, the cap 400 locks the rigid pole 310 in the end post 230. In this way, the anchoring system 300 connects to a panel 200 of the fence 100. The removal holes 440 may be sized to attach to a wrench to allow for easier removal of the cap 400.

The anchoring system 300 may include components made from various materials. The materials may be selected depending on the application. In some embodiments, the rigid pole 310 and stand 320 may be a metal material, such as steel. The metal may be insulated, especially in electric fence applications. In some embodiments, the cap 400 may be a plastic material. In this way, the cap 400 may insulate the rigid pole 310 from the exterior portion of the fence 100.

Figure 6:
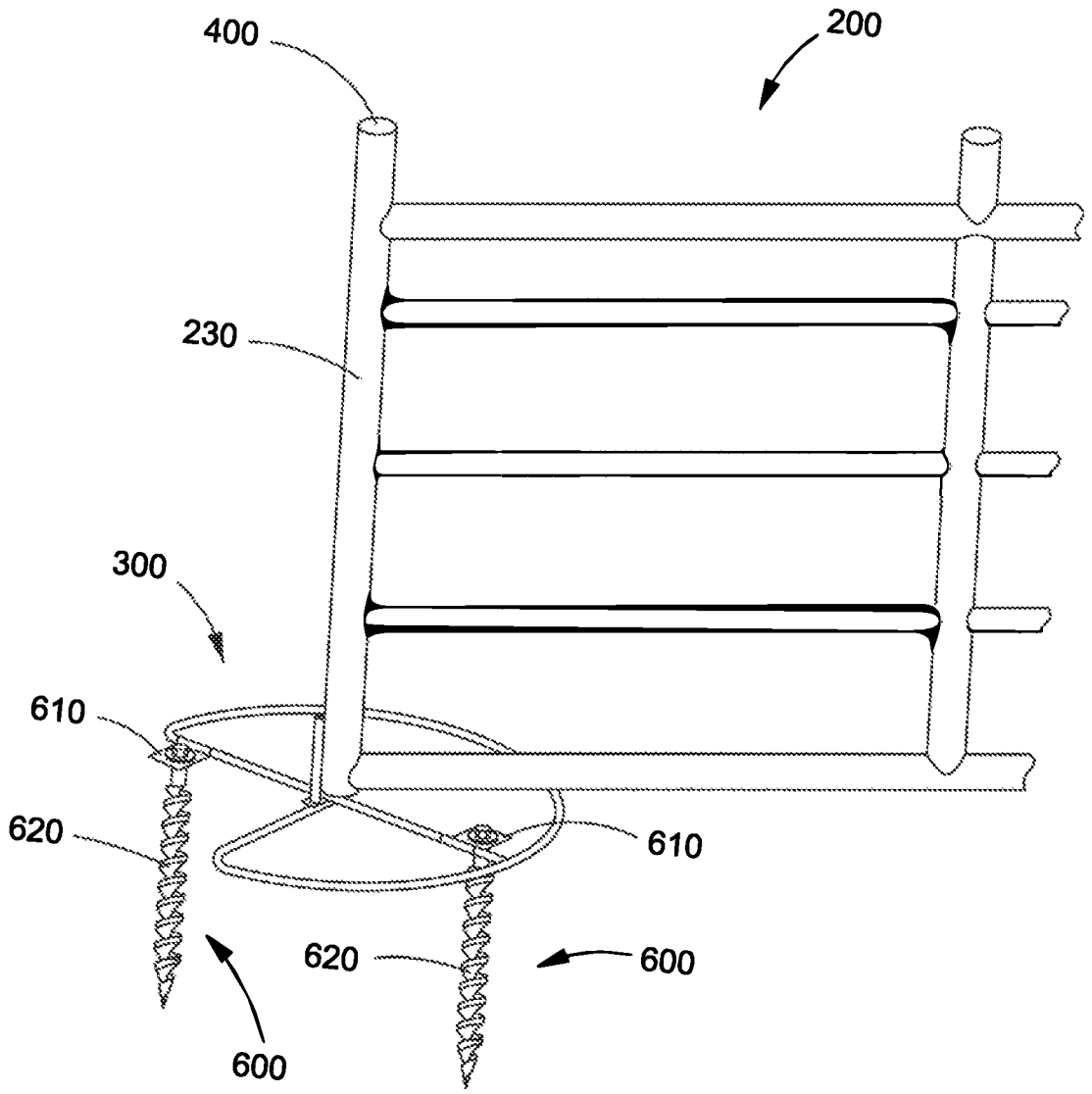
FIG. 6 is a perspective illustration of a panel and anchoring system, including in-ground anchors.

FIG. 6 further illustrates the anchoring system 300 connected to a panel 200. The anchoring system further includes in-ground anchors 600. The in-ground anchors 600 are configured to secure the anchoring system 300 (and thus the connected panel 200) to the ground or other subsurface. The in-ground anchors 600 may include at least one bracket 610 and at least one threaded anchor 620. The bracket 610 connects the threaded anchor 620 to the stand 320 and the threaded anchor 620 is secured in the ground.

Figure 7A:
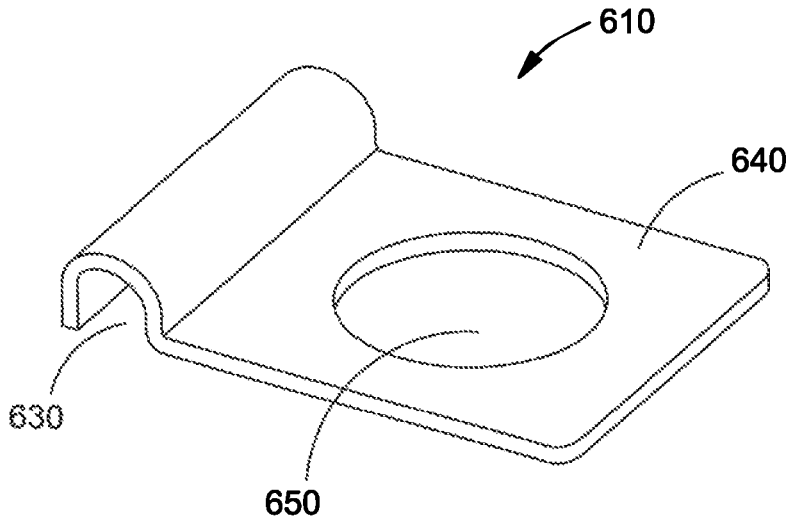
FIG. 7A is a perspective view of an exemplary bracket that may be used as part of the in-ground anchors of FIG. 6, according to an embodiment.
Figure 7B:
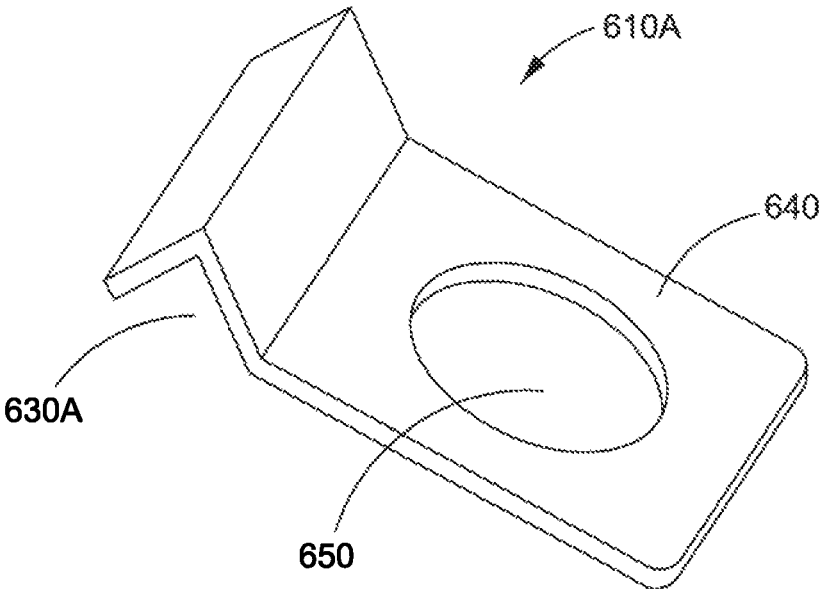
FIG. 7B is a perspective view of an exemplary bracket that may be used as part of the in-ground anchors of FIG. 6, according to another embodiment.

FIG. 7A further illustrates an exemplary embodiment of the bracket 610. In one embodiment, the bracket 610 includes a channel 630 for receiving a portion of the stand 320. For example, the channel 630 may be a curved receptacle for receiving a portion of a wire frame. In other embodiments, the bracket 610 may include other features for connecting to the stand 320. The bracket 610 also includes a flange 640 and a hole 650. The flange 640 may be configured to rest parallel to the ground and the hole 650 receives a threaded anchor 620 therethrough. FIG. 7B illustrates another bracket 610A. The bracket 610A is similar to the bracket 610, including the flange 640 and hole 650. However, the bracket 610A includes an angled channel 630A for attaching to the stand 320. It should be understood that the channels 630, 630A may have other shapes and configurations to receive or attach to the stand 320.0

Figure 8A:
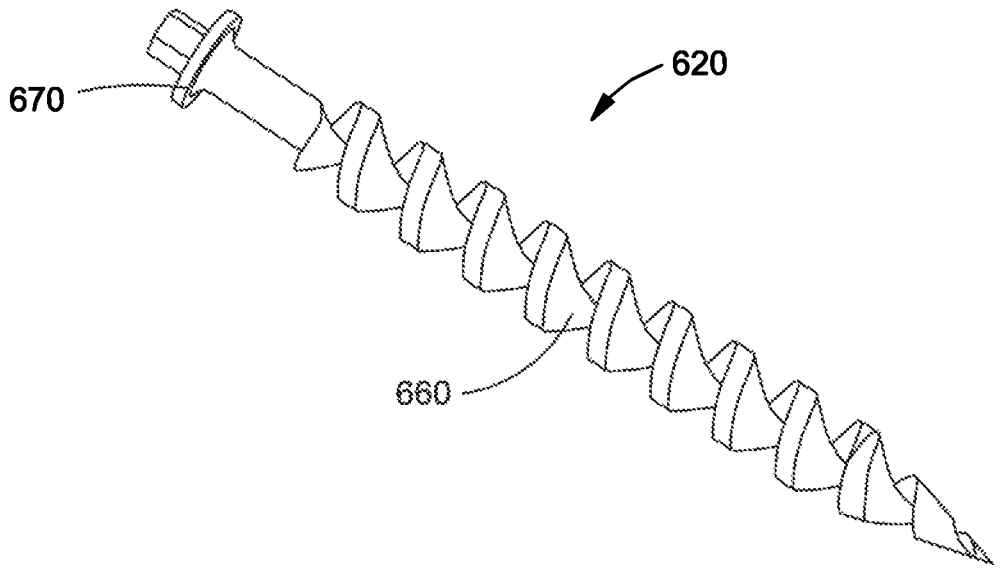
FIG. 8A is a perspective view of a threaded anchor that may be used as part of the in-ground anchors of FIG. 6.
Figure 8B:
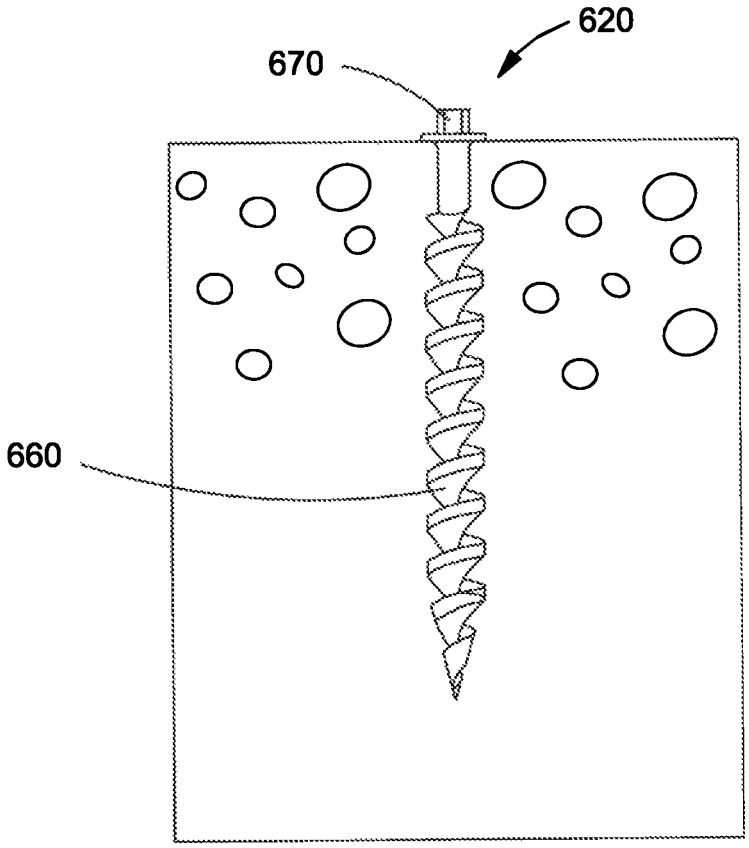
FIG. 8B is a side view of the threaded anchor in the ground.

FIGS. 8A-8B further illustrate an exemplary embodiment of a threaded anchor 620. The threaded anchor 620 may include a threaded end 660 and a connection end 670. The threaded end 660 is configured to pass through the hole 650 in the bracket 610 while the connection end 670 is not. The threaded end 660 is configured to be embedded in the ground, as shown in FIG. 8B.

The disclosed anchoring system for a fence includes features that enable secure connection of a rigid pole to a portion of the fence and anchoring of the rigid pole to the ground or other subsurface. In this way, the fence may be secured to the ground and inhibited from unwanted movement, even under high wind conditions. The features of the anchoring system, such as the size and/or number of the threaded anchor, may be selected to produce a desired pull-out strength for the anchoring of the fence.

The disclosed anchoring system is particularly applicable to a modular fence, as the anchoring system includes features that maintain the modularity of a fence panel. In particular, configuration of the top connector as a threaded cap allows the cap to be removed and the end post to be pulled off of the rigid pole such that the fence panel is free to be moved or replaced. The configuration of the anchoring system to include a shorter adjacent post next to the rigid pole allows an adjacent fence panel to be connected.

The disclosed anchoring system is also particularly applicable to electric fencing. Typically, it is undesirable to include metal components in electric fencing because of the possibility of the electric current leaking to the conductive material. However, the embedded configuration of the anchoring system extending inside of the end post of the fence panel, allows the rigid pole of the anchoring system to be made from a metal material that provides sufficient strength, weight, and rigidity to securely anchor the fence. The top connector, which may be a plastic cap, helps to insulate the rigid pole from the electrified elements of the fence.

A fence, such as the fence 100 shown in FIG. 1, that utilizes a plurality of anchoring systems, may be constructed as a securely anchored fence that maintains modular functionality. In one embodiment, a first end post (such as a left-side end post 230 as shown in FIG. 2) of a first fence panel may be secured to the rigid pole of a first anchoring system through a top connector and anchored to the ground. A second end post (such as the right-side end post 230 as shown in FIG. 2) may be placed on the adjacent post 330 of a second anchoring system that anchors a second fence panel to the ground. Similarly, an end post of a third fence panel may be placed on the adjacent post of the first anchoring system, thereby creating an alternating pattern of fence panel connections that creates a securely anchored fence while allowing at least one of the panels to be lifted and moved at each anchoring point. Moreover, the removable top connector enables the entire fence to be disassembled.

An anchoring method may include steps of sequentially securing a selected number of adjacent fence panels to anchoring systems of the disclosed embodiments. The method may include inserting the rigid pole of each anchoring system into an end post, securing the top connector, anchoring the base to the ground with the in-ground anchors, and placing the opposite end post on an adjacent post of an adjacent anchoring system. The method may include repeating this process while following a desired fence line until all of the selected fence panels are in place and anchored to the ground.

The elements of the figures are not exclusive. Other embodiments may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

What is claimed is:

1. An anchoring system for a fence, comprising:
- a hollow end post of a fence panel;
- a stand configured to form a base;
- a rigid pole extending upwardly from the stand through the hollow end post, the rigid pole comprising a threaded upper end,
- a top connector configured to engage with the threaded upper end of the rigid pole, wherein the top connector fits into an upper end of the hollow end post to thereby removably attach the rigid pole to the hollow end post; and
- at least one in-ground anchor configured to secure the stand to a subsurface.

2. The anchoring system of claim 1, wherein the top connector is a threaded cap.

3. The anchoring system of claim 2, wherein the threaded cap includes a top surface, a plug, and a threaded element.

4. The anchoring system of claim 3, wherein the top surface includes a greater diameter than the plug.

5. The anchoring system of 2, wherein the rigid pole is formed from a metal material and the threaded cap is formed from a non-conductive material.

6. The anchoring system of claim 5, wherein the threaded cap is formed from plastic.

7. The anchoring system of claim 1, wherein the at least one in-ground anchor comprises a bracket configured to attach to the stand and a threaded anchor.

8. The anchoring system of claim 7, wherein the bracket comprises a channel configured to receive a portion of the stand and a flange having a hole configured to receive a portion of the threaded anchor.

9. The anchoring system of claim 7, wherein the threaded anchor comprises a threaded end configured to be secured in the ground and a connection end configured to connect to the bracket.

10. A fence, comprising:
- a fence panel comprising a plurality of vertical posts, including at least one hollow end post; and
- an anchoring system comprising:
  - a stand configured to form a base;
  - a rigid pole extending upwardly from the stand through the hollow end post, the rigid pole comprising a threaded upper end;
  - a top connector configured to engage with the threaded upper end of the rigid pole, wherein the top connector fits into an upper end of the hollow end post to thereby removably attach the rigid pole to the hollow end post; and
  - at least one in-ground anchor configured to secure the stand to a subsurface.

11. The fence of claim 10, wherein the top connector is configured to prevent the rigid pole from being pulled out of the hollow end post.

12. The fence of claim 11, wherein the top connector is a threaded cap.

13. The anchoring system of claim 12, wherein the threaded cap includes a top surface, a plug, and a threaded element.

14. The anchoring system of claim 13, wherein the top surface includes a greater diameter than the plug and wherein the plug fits in an opening into the hollow end post and the top surface does not fit into the opening.

15. The fence of claim 10, wherein the fence panel further comprises an electrified grid and wherein the rigid pole is formed from a metal material.

16. A fence, comprising:

a plurality of fence panels, each fence panel comprising a first hollow end post and a second hollow end post, a plurality of anchoring systems, each anchoring system comprising:

a stand configured to form a base;

a rigid pole extending upwardly from the stand through the respective hollow end post, the rigid pole comprising a threaded upper end;

a threaded cap configured to engage with the threaded upper end of the rigid pole, wherein the threaded cap fits into an upper end of the respective hollow end post to thereby removably attach the rigid pole to the respective hollow end post of a fence panel of the plurality of fence panels; and at least one in-ground anchor configured to secure the stand to a subsurface wherein each anchoring system is configured to secure a respective one of the plurality of fence panels to a subsurface and connect to an adjacent one of the plurality of fence panels to form an interconnected fence along a fence line.

17. The fence of claim 16, wherein the plurality of fence panels each further comprise an electrified grid.

* * * * *